US010820701B2

(12) United States Patent
Sobolewski et al.

(10) Patent No.: US 10,820,701 B2
(45) Date of Patent: Nov. 3, 2020

(54) WALL OF A FURNITURE CARCASS, METHOD FOR PRODUCING SUCH A WALL, AND FURNITURE CARCASS OR FURNITURE COMPRISING SUCH A WALL

(71) Applicant: AMBIGENCE GMBH & CO. KG, Herford (DE)

(72) Inventors: Uwe Sobolewski, Bünde (DE); Michael Tasche, Bielefeld (DE); Stefan Andschus, Lübbecke (DE); Michael Schubert, Coburg (DE)

(73) Assignee: AMBIGENCE GMBH & CO. KG, Herford (DE)

( * ) Notice: Subject to any disclaimer, the term of this patent is extended or adjusted under 35 U.S.C. 154(b) by 0 days.

(21) Appl. No.: 16/489,159

(22) PCT Filed: Feb. 23, 2018

(86) PCT No.: PCT/EP2018/054538
§ 371 (c)(1),
(2) Date: Aug. 27, 2019

(87) PCT Pub. No.: WO2018/158159
PCT Pub. Date: Sep. 7, 2018

(65) Prior Publication Data

US 2020/0060422 A1 Feb. 27, 2020

(30) Foreign Application Priority Data

Feb. 28, 2017 (DE) ..... 10 2017 104 169

(51) Int. Cl.
*A47B 96/20* (2006.01)
*E05D 15/46* (2006.01)

(52) U.S. Cl.
CPC ..... *A47B 96/205* (2013.01); *E05D 15/463* (2013.01); *E05Y 2900/20* (2013.01)

(58) Field of Classification Search
CPC ..... A47B 96/04; A47B 96/20; A47B 96/205; A47B 96/206; A47B 2220/0052;
(Continued)

(56) References Cited

U.S. PATENT DOCUMENTS 3,351,402 A * 11/1967 Barecki ..... A47B 19/00 312/233
3,421,459 A * 1/1969 Sherwood ..... A47B 87/002 108/13

(Continued)

FOREIGN PATENT DOCUMENTS

DE 1559963 A1 12/1969
DE 102009025822 A1 11/2010

(Continued)

OTHER PUBLICATIONS

International Search Report mailed Apr. 17, 2018 in related/corresponding International Application No. PCT/ EP2018/054538.

(Continued)

*Primary Examiner* — Andrew M Roersma
(74) *Attorney, Agent, or Firm* — Patent Portfolio Builders PLLC

(57) ABSTRACT

A wall for a furniture carcass has a panel-type core arranged between two laterally positioned cover layers. The core has a cut-out extending at least along one section of an end face of the wall and is used to receive a fitting that guides a movable furniture part. The fitting rests at least against one of the cover layers.

20 Claims, 12 Drawing Sheets

(58) Field of Classification Search
CPC .... A47B 2220/0069; A47B 2220/0072; E05Y 2900/20; E05D 15/463
See application file for complete search history.

(56) References Cited

U.S. PATENT DOCUMENTS

| | | | | | |
|---|---|---|---|---|---|
| 3,612,639 | A * | 10/1971 | Williams | A47B 88/9416 312/310 |
| 3,697,147 | A * | 10/1972 | Schulte | A47B 91/00 312/111 |
| 5,218,739 | A * | 6/1993 | Lautenschlager | E05D 11/1014 16/321 |
| 8,359,985 | B2 * | 1/2013 | Wangdak | A47B 47/042 108/158.12 |
| 8,613,824 | B2 * | 12/2013 | Kappacher | A47B 96/206 156/244.11 |
| 2015/0272346 | A1 * | 10/2015 | Aumiller | A47F 3/0426 312/204 |

FOREIGN PATENT DOCUMENTS

| | | | | | |
|---|---|---|---|---|---|
| DE | 202011003953 | U1 | | 5/2011 | |
| DE | 202011103747 | U1 | * | 11/2011 | B32B 33/00 |
| DE | 202013003189 | U1 | | 7/2014 | |
| DE | 202014104306 | U1 | * | 9/2014 | A47B 96/20 |
| FR | 911099 | A | | 6/1946 | |
| WO | WO-2009152537 | A2 | * | 12/2009 | E05F 15/63 |
| WO | WO-2010130569 | A1 | * | 11/2010 | A47B 96/205 |

OTHER PUBLICATIONS

Written Opinion mailed Apr. 17, 2018 in related/corresponding International Application No. PCT/EP2018/054538.

* cited by examiner

WALL OF A FURNITURE CARCASS, METHOD FOR PRODUCING SUCH A WALL, AND FURNITURE CARCASS OR FURNITURE COMPRISING SUCH A WALL

BACKGROUND AND SUMMARY OF THE INVENTION

Exemplary embodiments of the invention relate to a wall, in particular a side wall, of a furniture body, having a panel-shaped core arranged between two laterally positioned cover layers, wherein the core has a recess extending at least along a section of an end face of the wall and is used to receive a fitting which guides a movable furniture part. Exemplary embodiments of the invention also relate to a method for manufacturing such a wall and a furniture body or a piece of furniture having such a wall.

Furniture, in particular kitchen furniture such as base units or wall units, generally have a furniture body open towards the front, on which movable furniture parts guided by fittings are mounted. The movably guided furniture parts can be drawers with a drawer front or doors or flaps, which can be used individually or in different combinations in a furniture body. The present application relates in particular to the use of doors and flaps as movable furniture components. For the purposes of this application, doors and flaps are distinguished by the orientation of their pivot axis, which is vertical for doors and horizontal for flaps.

The doors and flaps can be integral or consist of several individual parts, such as a folding flap in which different parts of the flap move relative to each other in the movement sequence.

Door hinges are usually used to guide doors, which are arranged on the side of the pivot axis between the furniture body and the door. A comparable arrangement of hinges can also be used for flaps. These hinges are then arranged along an upper side edge of the flap. However, it is often desired to open the flaps in a combined pivoting and sliding movement in order, for example in the case of a wall cabinet, to obtain the greatest possible access to the interior of the cabinet without having to pivot the flap into a horizontal position in which it is difficult or impossible for the user to reach it to close. For this reason, special flap fittings have become established that are not arranged along the pivot axis between the furniture body and the flap, but on the side edges (usually both) between the flap and the side wall of the furniture body.

Such door hinges or flap fittings are well known for mounting on the inside of the side wall or side walls of the furniture body. However, the fittings inevitably protrude into the interior of the furniture body, which on the one hand reduces the usable storage space within the furniture body and on the other hand also impairs the structuring of the interior of the furniture body. The mounted fittings also make it difficult to clean the interior, especially the inside of the side wall of the furniture body. Last but not least, a side wall on which no fittings are mounted is desirable for optical reasons.

For the assembly of door hinges it is known to mill a pocket into the end face of a side wall in which the door hinge can be inserted from the front. In this way, the inside of the side wall remains free. A hinge suitable for use in such a milled pocket is known from the publication DE 1 559 963 A, for example.

However, this procedure is only suitable for door hinges with a very low installation depth. This is due to the limited milling depth with which such a pocket can be economically milled from the end face into the side wall during the manufacturing process. The installation thickness of the door hinge inserted in such a milled pocket is also very limited, as the side walls in the furniture area only have a wall thickness of about 16-20 mm (millimeters). During the milling process, a certain minimum wall thickness must remain on the side of the milled pockets, since a wall that is too thin would tear or break during the milling process or would be deformed in such a way that it no longer has a perfect surface.

Even the use of larger and more complex door hinges is not possible in this way. Flap hinges usually have a large installation depth of more than 10 or 15 cm (centimeters), which cannot be achieved by milling from the end face.

Publication DE 20 2013 003 189 U1 discloses a side wall for a furniture body that is made of different parts in sections. In particular, a rear part facing away from the furniture front is conventionally designed, e.g., by a coated wooden element. A front part of the side wall is formed by a housing, not described in detail in the above publication, which has a front opening into which a fitting can be inserted. The housing is connected to the conventional part of the side wall, e.g., via dowels or screws. Since the housing can be provided with thinner housing walls than is possible by milling and also allows larger installation depths, this housing can also be used to accommodate larger door hinges or a flap fitting. However, the surface appearance and haptics of the housing will generally not correspond exactly to those of the conventional part of the side wall, so that a uniform surface of the side wall cannot be achieved. In addition, a transition between the two housing parts will be visible and optionally also perceptible.

Exemplary embodiments of the present invention are directed to a wall and a method for producing a wall for a furniture body and a piece of furniture or furniture body with a wall, wherein the wall is also able to accommodate larger fittings, in particular flap fittings, but also door hinges with a larger installation depth, and the wall is characterized by a uniform surface quality on both its outside and inside.

A wall of the type mentioned at the beginning and according to the invention is characterized in that the fitting rests against at least one of the cover layers.

A method according to the invention for the manufacture of such a wall for a furniture body comprises the following steps. A panel-shaped core is provided into which a recess is introduced which extends along at least a section of one end face of the core. Two lateral cover layers are then applied to the core.

The wall according to the invention is thus a composite element consisting of a core and cover layers, wherein the recess in the core required to accommodate the fitting is thus, in accordance with the invention, already made during the production of the wall before the cover layers are applied. Thus, there are no restrictions on the size of the recess, as is the case when the recess for the fitting is made in a wall that has already been provided with cover layers. This means that large fittings can also be used which, for example, take up the entire or almost the entire width of the wall. At the same time, the wall has a preferably integral, continuous cover layer on both sides.

For example, the recess can be milled out of the core, preferably from one of the side surfaces of the core. Alternatively, the core, which can, for example, be made of a fiber material, can also be produced directly with the recess in a primary forming process.

In an advantageous embodiment of the method, a fitting is inserted into the recess before at least one of the two lateral cover layers is applied to the core. Preferably, the fitting is also connected to the core before the cover layer is applied or the cover layers are applied. For example, the fitting can be screwed and/or clamped and/or glued to the core before at least one of the two lateral cover layers is applied to the core. The result is a wall for a furniture body with a firmly integrated fitting, which simplifies the production of the furniture body.

In an advantageous embodiment of the wall, the fitting rests against both cover layers and is preferably connected to the core and/or at least one of the cover layers. This provides the fitting with an installation width that corresponds to the maximum thickness of the core. Fittings with a width of up to approx. 20 mm can thus also be used for furniture walls of the usual thickness.

In a further advantageous embodiment of the wall, the core has a reduced thickness on at least one side along an edge of the recess, such that a bung spring is formed facing towards the recess and projects into the fitting. The fitting preferably has two parallel side plates, between which a gap is formed at least in sections along one edge, into which the bung spring protrudes. In this way, the fitting is fitted to a certain extent onto the area of smaller thickness of the core, which ensures a good connection between core and fitting and results in a transition as free as possible of steps, which is not visible from the outside even with relatively thin cover layers. In the overlap area between fitting and core, screws or clamps can connect the side plates of the fitting with the core.

Heads of the screws or overlapping sections of the clamps are preferably arranged between the side plates and the cover layers so that these connecting elements are covered by the cover layers and are therefore no longer visible on the composite element. The heads of the screws or the overlapping sections of the clamps are preferably countersunk in the side plates so that they do not stand out under the cover layers.

An alternative method of connection, which is particularly simple in the production process of the wall, is provided by staples, which are placed on the fitting from the side plates and clamp into the core in order to connect the side plates with the core. Alternatively or additionally, the fitting may be bonded to the core and/or at least one of the two cover layers.

In another alternative connection method, which is also particularly simple in the wall manufacturing process, connecting elements are formed from the core adjacent to the recess, which engage in the fitting. The fitting then has side plates with recesses, with the recesses forming mating contours into which the connecting elements fit. Core and fitting are therefore laid one inside the other like puzzle pieces and are connected to each other in a form-fit manner. The role of connecting elements and recesses as contours and mating contours can of course also be reversed, so that the recess is formed in the core and the engaging connecting element in the fitting.

In another advantageous embodiment of the wall, the fitting can have two parallel side plates whose spacing corresponds to the thickness of the core. It is also possible for the fitting to have an adjustment unit in order to vary the distance between the side plates and thus be able to compensate for the thickness of the core.

In another advantageous embodiment of the wall, the fitting comprises a lever mechanism that guides the movable part of the furniture. When the movable part of the furniture is closed, the lever mechanism is preferably located between the cover layers. The fitting is then so completely integrated into the furniture body that—unavoidably—only the lever mechanism is visible, and even this only when the movable part of the furniture is open.

In another advantageous embodiment of the wall, at least one edge band is applied to at least one end face of the core. In the area of the front end face of the core, the edge band is preferably applied only when the fitting has been integrated or inserted, wherein the edge band is arranged at least in sections on the fitting. In this way, for example, the edges of the side plates of the fitting can be covered.

A piece of furniture or furniture body according to the invention has at least one such wall manufactured in accordance with a method described above. This leads to the advantages described in connection with the wall or the method.

In an advantageous embodiment of the piece of furniture or furniture body, at least one wall is a side wall and/or a partition wall. The fitting can be a flap fitting or a door fitting.

In the context of the application, the wall according to the invention may be arranged on either side of the furniture body, irrespective of its orientation. In particular, the wall can be arranged in any orientation within the furniture body, especially vertically, horizontally or diagonally, for example diagonally in the furniture body.

BRIEF DESCRIPTION OF THE DRAWING FIGURES

The invention will be explained in more detail in the following by means of embodiment examples shown in the figures, wherein:

FIG. 1 shows a first embodiment example of a piece of furniture with a wall according to the application;

FIGS. 2*a*, 2*b* show a second embodiment example of a piece of furniture having a wall according to the application in two different opening positions of a flap;

FIGS. 3*a*, 3*b* show a third embodiment example of a piece of furniture having a wall according to the application in two different opening positions of a flap;

Figure 6A:
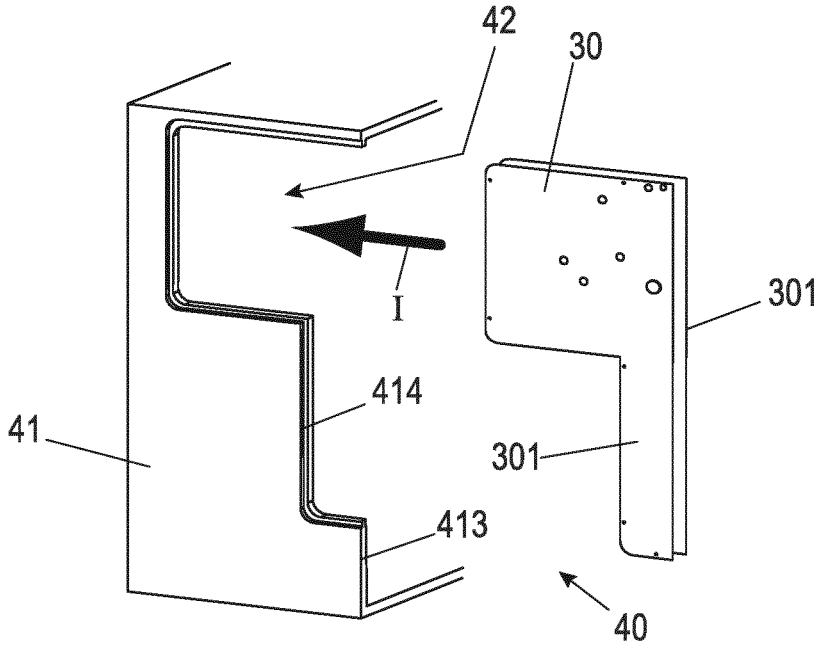
Figure 6B:
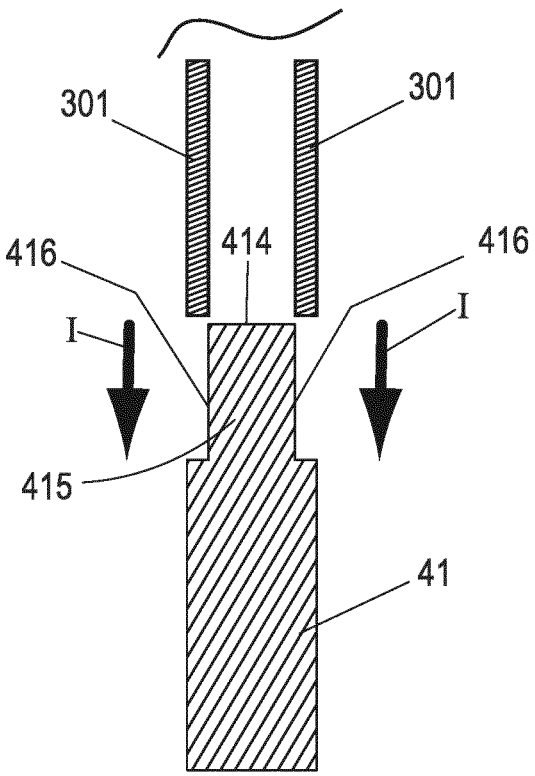

FIG. 6*a* shows a second embodiment example of a wall according to the application and designed as a composite element in a schematic isometric drawing in an intermediate stage of its production;

FIG. 6*b* shows a sectional drawing of a detail of the second embodiment example of the wall according to the application pursuant to FIG. 6*a;*

Figure 6C:
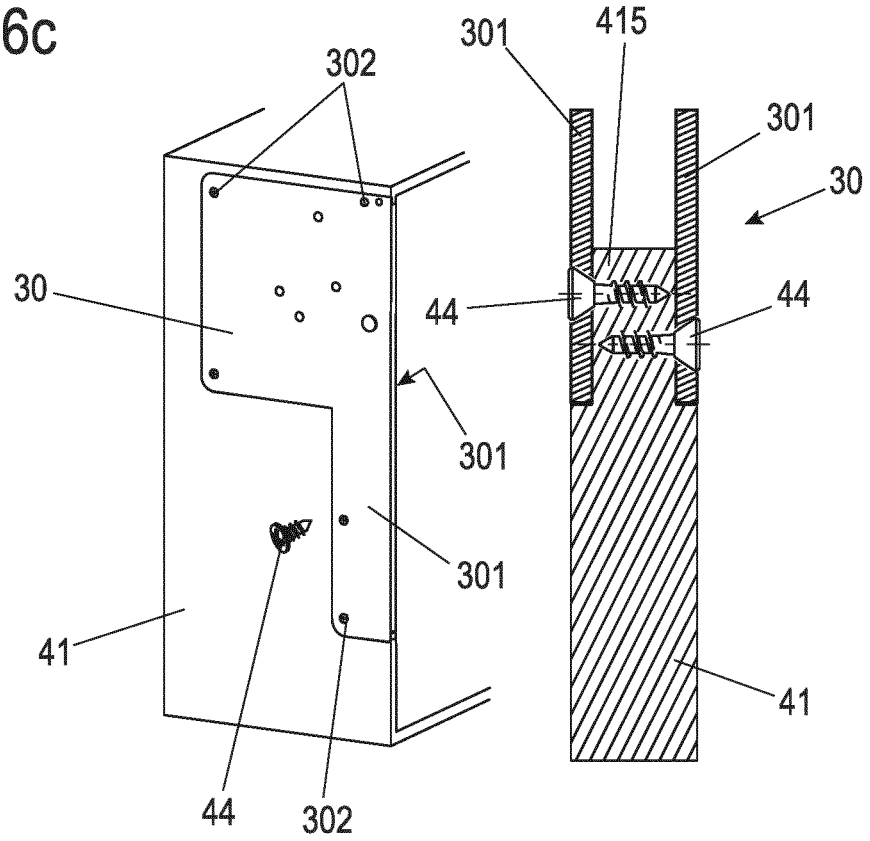
Figure 7:
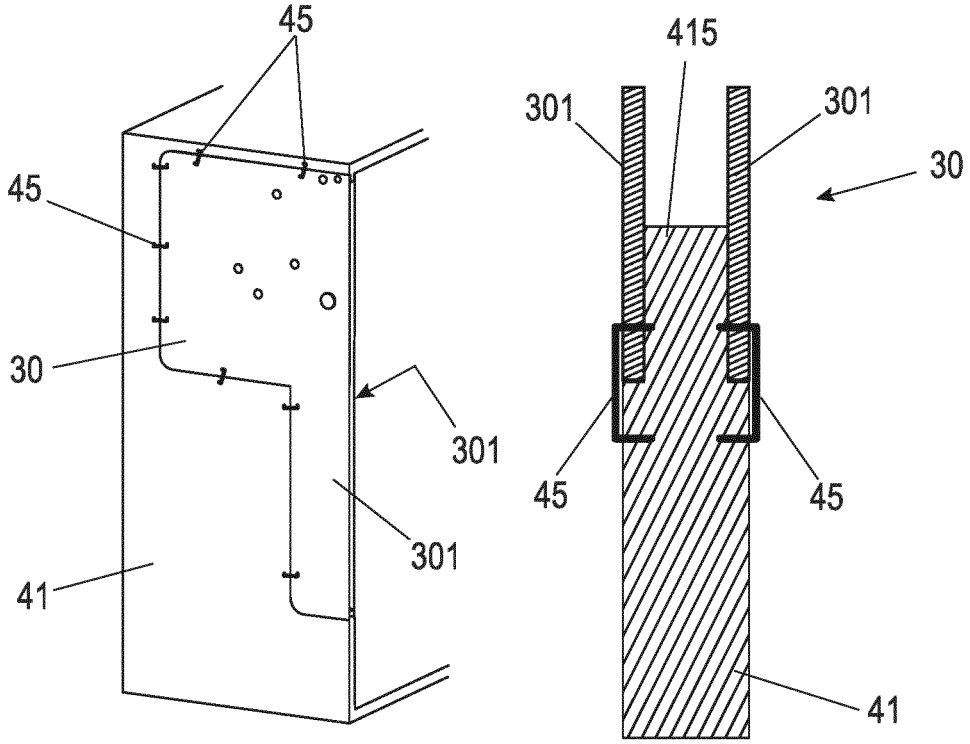
Figure 8:
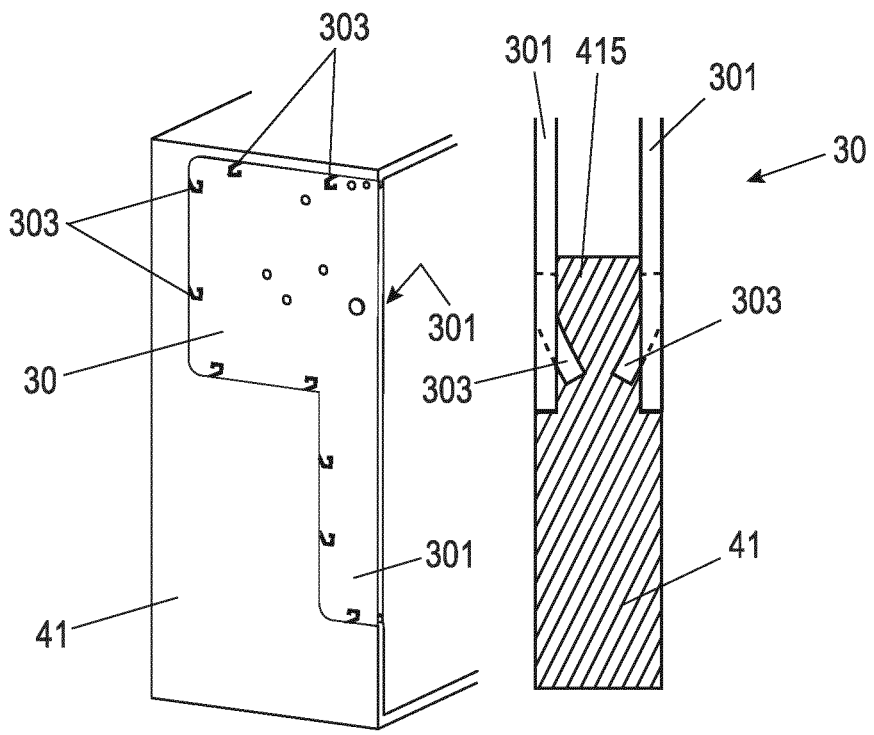
Figure 9:
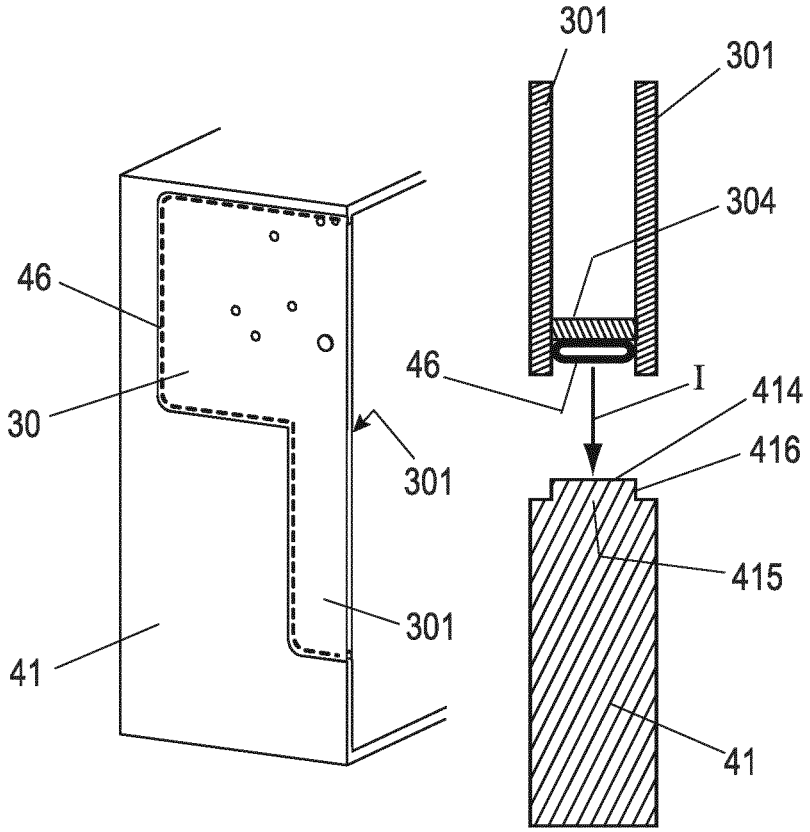
Figure 10:
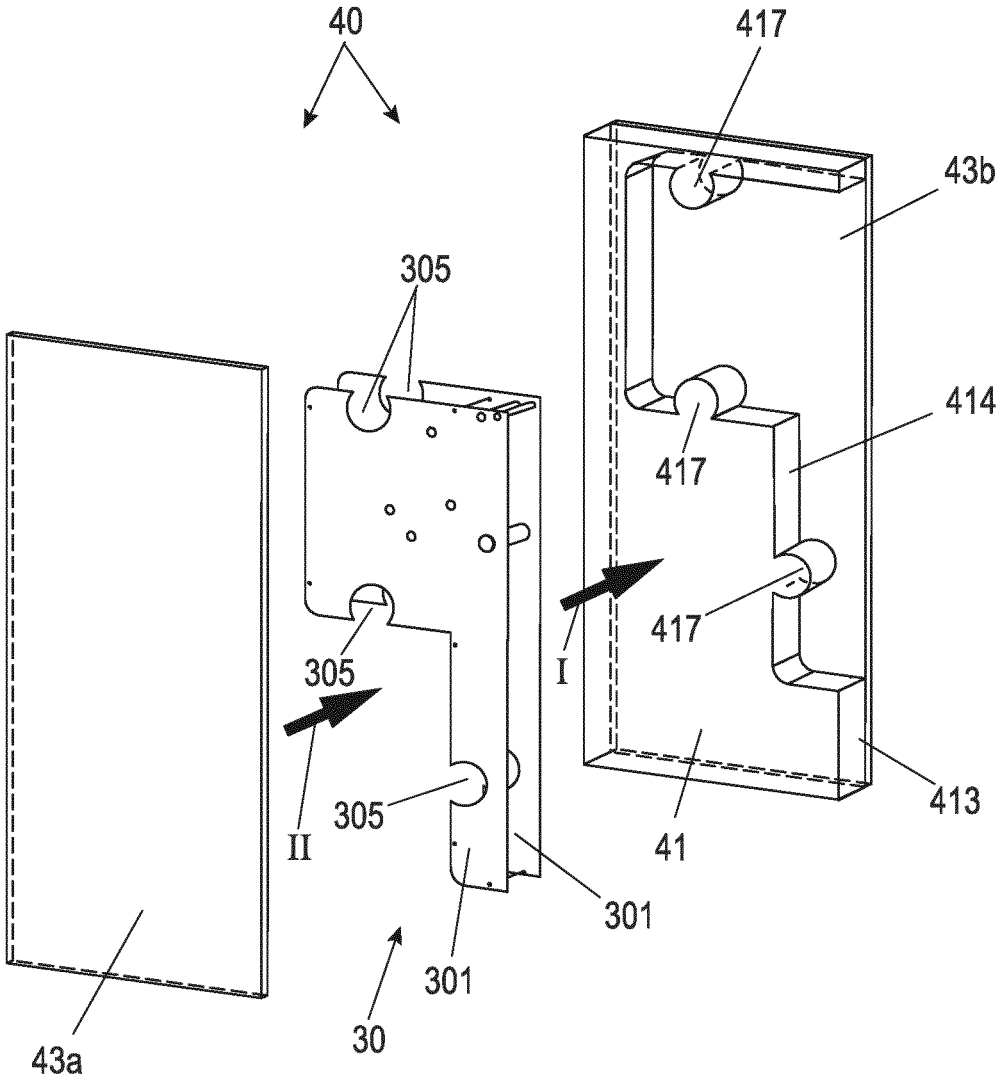
Figure 11:
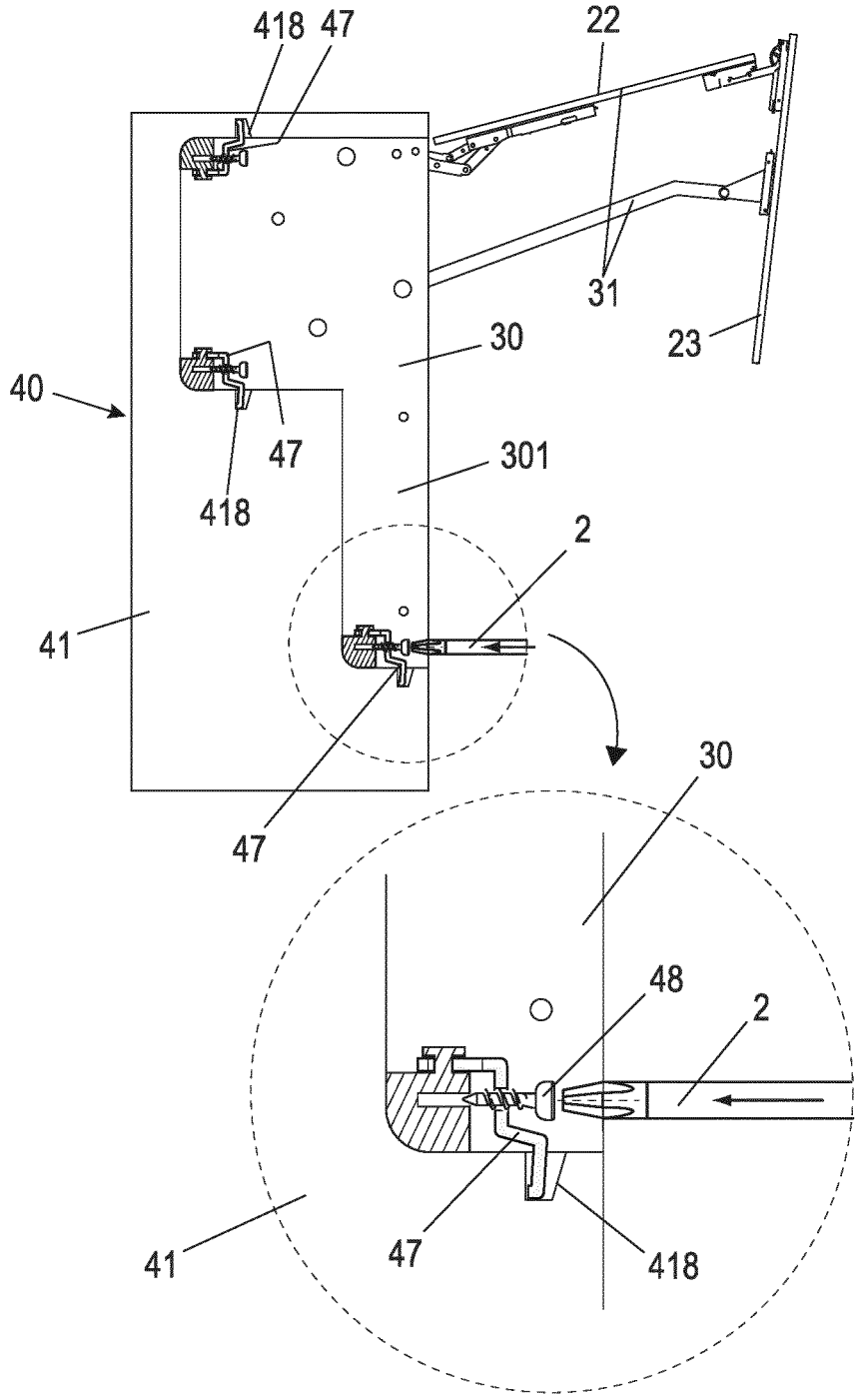
Figure 12:
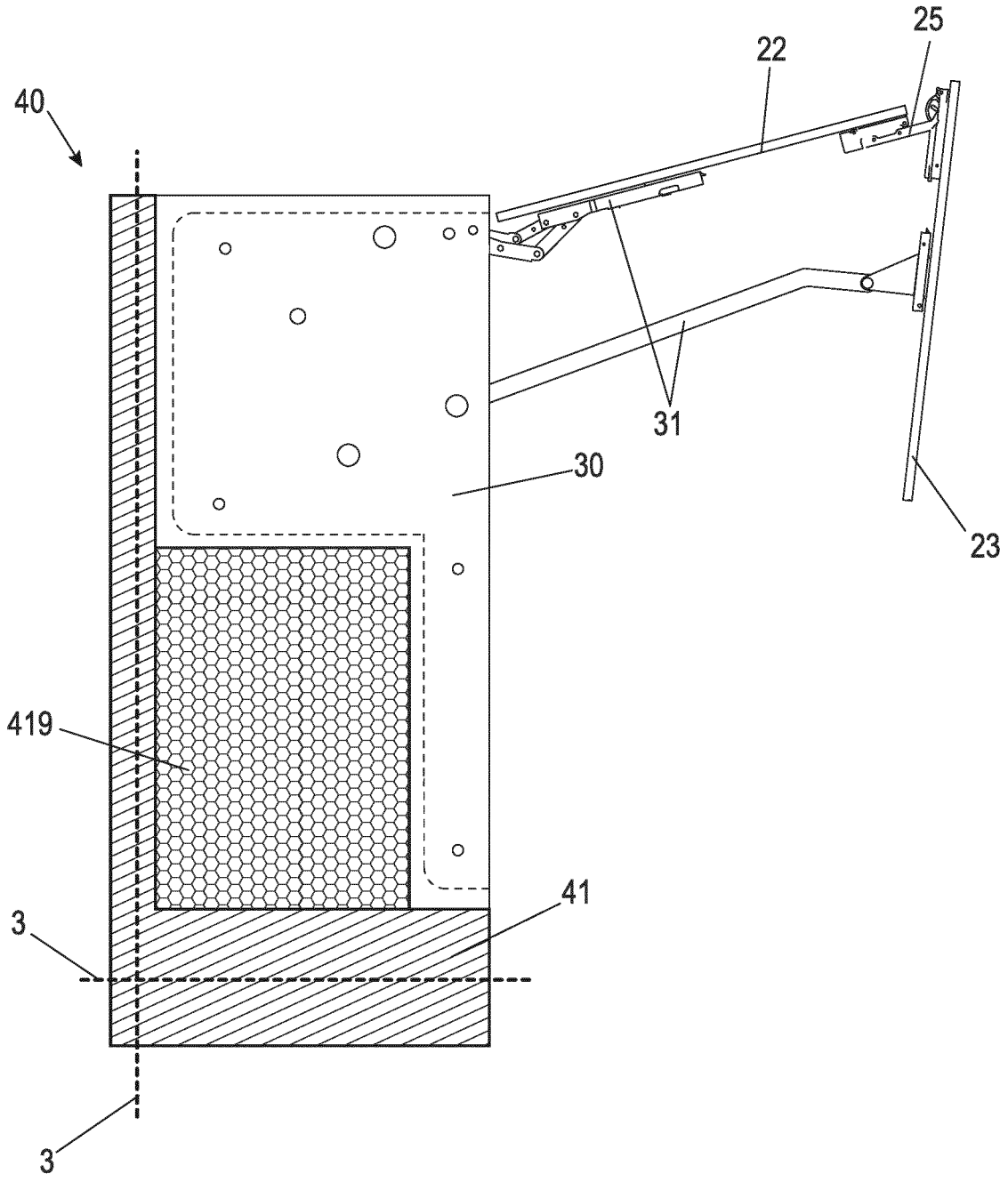
Figure 13:
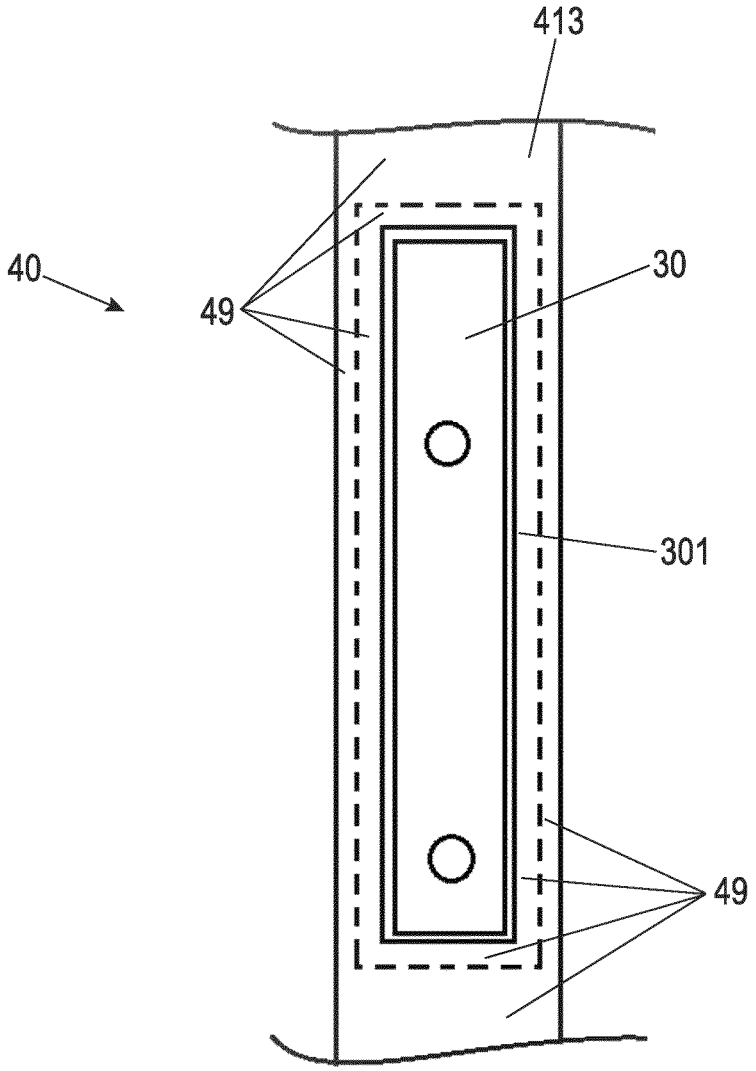

FIG. 6*c* shows a sectional drawing of the detail of the second embodiment example of the wall according to the application pursuant to FIG. 6*a* in a further intermediate stage of its manufacture;

FIGS. 7-9 show in each case a further embodiment example of a wall designed as a composite element and according to the application in an intermediate stage of its production in a schematic isometric drawing (left in the figure) and a detailed sectional drawing (right in the figure);

FIG. 10 shows a further embodiment example of a wall designed as a composite element and according to the application in a schematic exploded view;

FIGS. 11, 12 show in each case a further embodiment example of a wall designed as a composite element and according to the application in a schematic side view; and FIG. 13 shows a schematic top view of a front end face of a composite element in the area of an inserted fitting.

DETAILED DESCRIPTION

Figure 1:
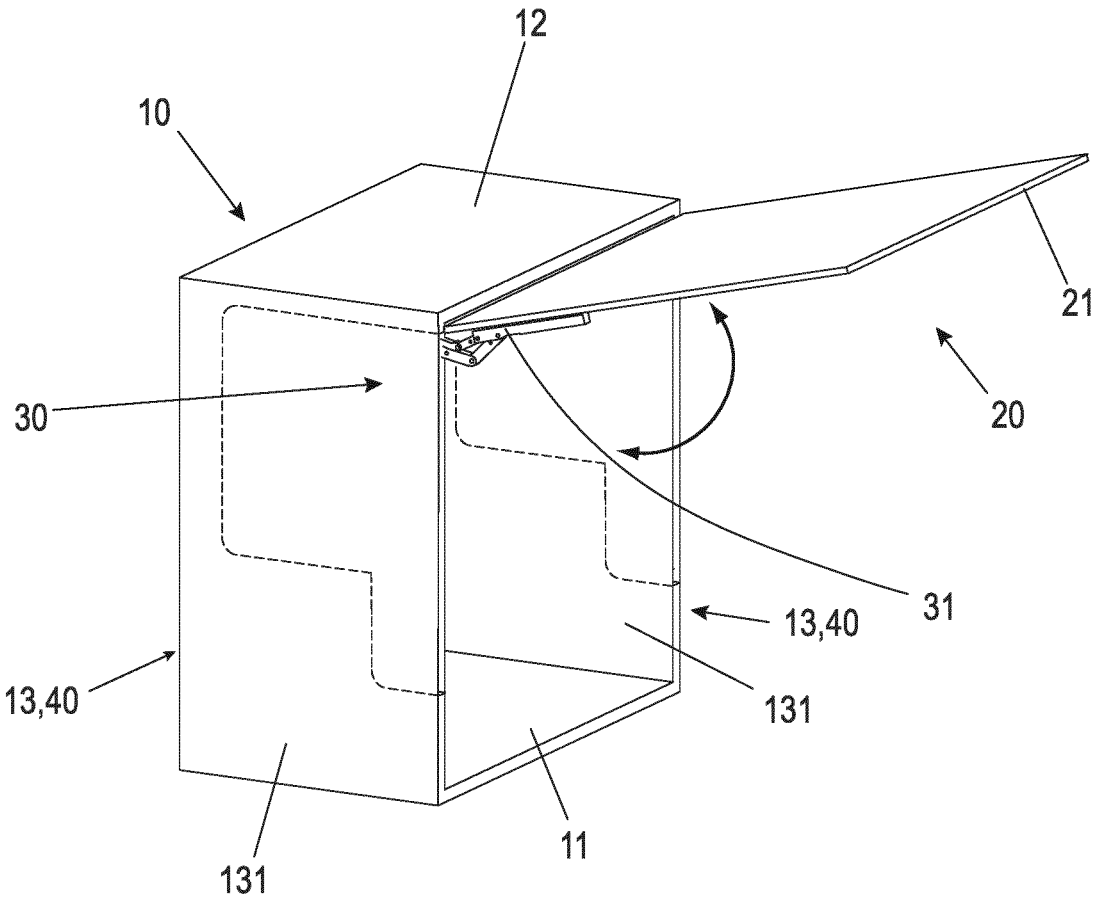

FIG. 1 shows in an isometric representation a wall unit of a kitchen, for example, as the first embodiment example of a piece of furniture with a (side) wall according to the application.

The wall unit comprises a furniture body 10 with a bottom panel 11, top panel 12, and two side walls 13. A rear wall is preferred for reasons of stability but is not shown in this embodiment example.

The furniture body 10 is open to the front to allow access to the interior of the cupboard. A flap arrangement 20 with an integral flap 21 is provided to close the opening of the furniture body 10. The integral flap 21 is pivoted along its upper horizontal side edge. For this purpose, fittings 30 are provided that are connected to the integral flap 21 with a lever mechanism 31 in the upper part of the flap 21.

The fittings 30 (with the exception of the lever mechanism 31 extended in the opening position shown) are arranged within the respective side wall 13. When flap 21 is closed, the lever mechanism 31 may be fully retracted into the side wall 13, optionally except for the mounting elements for connecting it to flap 21. The area within the side wall 13 in which the fitting 30 is located is indicated by a dashed line in FIG. 1.

The side wall 13 is characterized by side surfaces 131, which are ideally integral and can have the same surface texture throughout the entire surface. The surface of the integral side surfaces 131 can create design effects through different patterns, surface textures, or different colors. This preferably applies both to an outer side surface 131 and to an inner side surface 131 facing the interior of the furniture body 10. The side walls 13 also have an end face 132, which has an opening 133 in the area of the fitting 30, into which the lever mechanism 31 of the fitting 30 dips or from which the lever mechanism 31 extends. When the flap arrangement 20 is closed, the lever mechanism 31 is completely immersed in the opening 133, except for any fastening means with which it is connected to the integral flap 21.

According to the application, the side walls are 13 composite elements, which are explained in more detail in connection with the FIGS. 5-13.

Figure 2A:
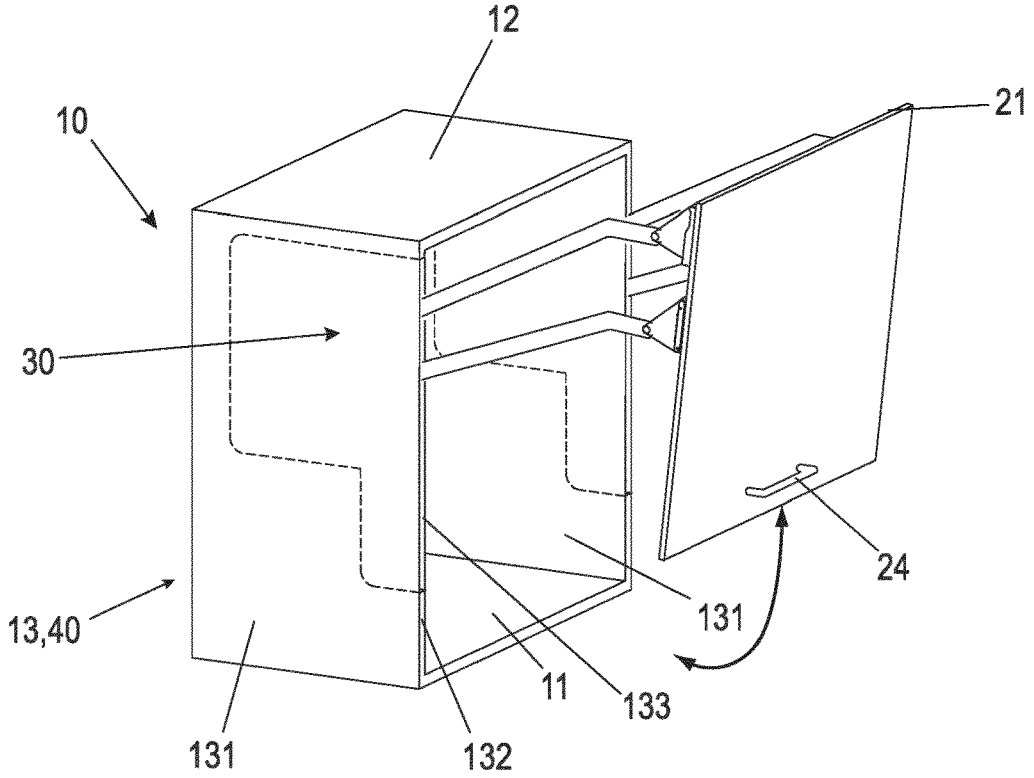
Figure 2B:
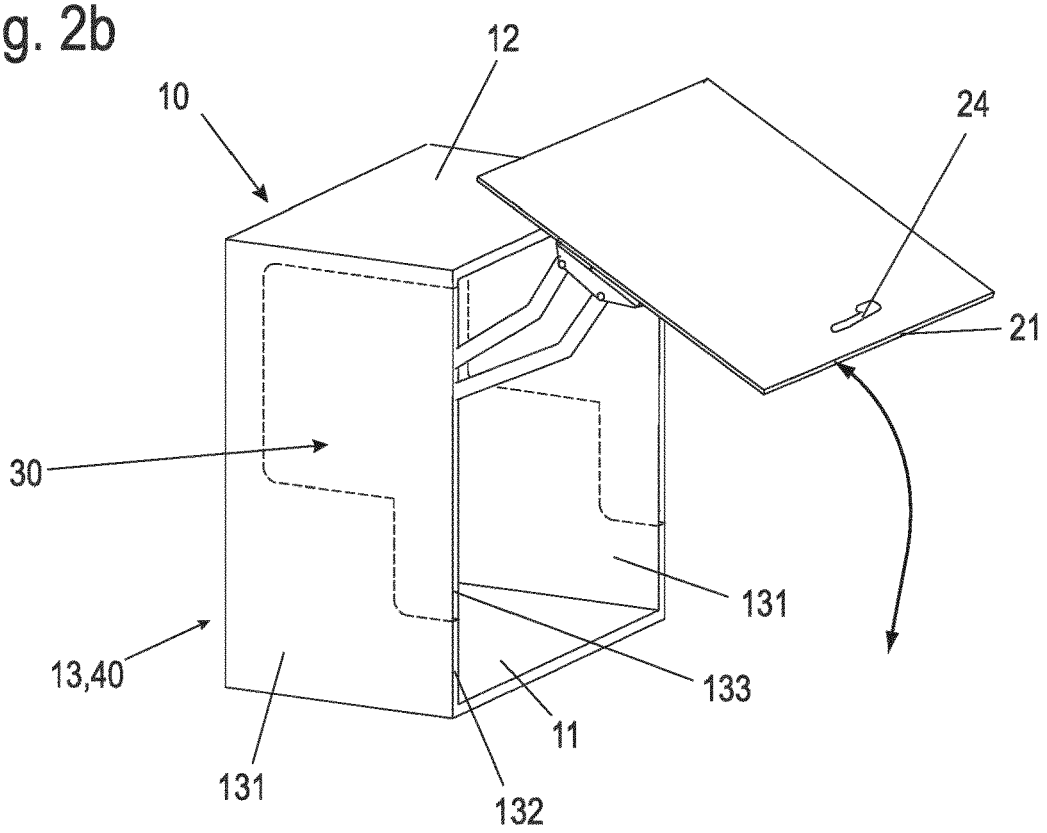

FIGS. 2*a* and 2*b* show another wall unit as an example of a piece of furniture with a side wall in accordance with the application, each in an isometric view.

As in the example in FIG. 1, an integral flap 21 is provided as flap arrangement 20 to close a furniture body 10 to the front. The two FIGS. 2*a* and 2*b* differ in the opening state of the flap arrangement 20. FIG. 2*a* shows a partially opened state of the flap arrangement 20, whereas FIG. 2*b* shows the maximum opening state of the flap arrangement 20. In contrast to the embodiment example in FIG. 1, a lifting and pivoting fitting is provided which enables a combined pivoting and displacing movement of the integral flap 21. In the fully open position shown in FIG. 2*b*, at least part of flap 21 is positioned above top panel 12 of furniture body 10. In this way, good access to the interior of furniture body 10 is achieved without the lower edge of flap 21, in the area of which a handle 24 is mounted, pivoting to the height of the upper floor 12. In this way, even if the wall unit is mounted high in the room, the flap 21 is easily accessible in the open position so that it can be closed again.

As in the embodiment example of FIG. 1, the side walls 13 are designed as composite elements 40, which accommodate the fitting 30.

Figure 3A:
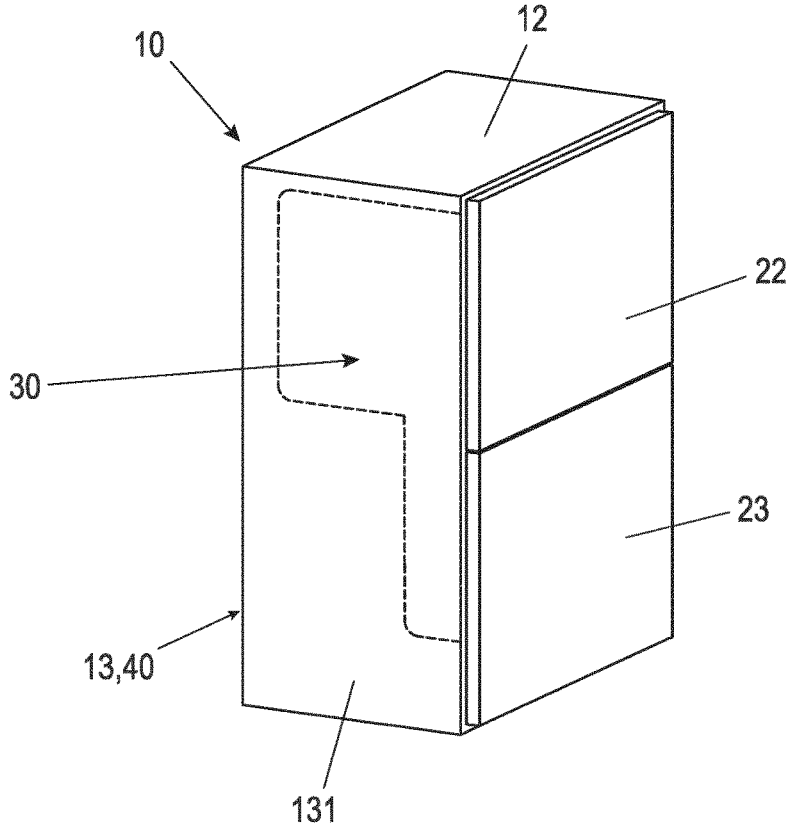
Figure 3B:
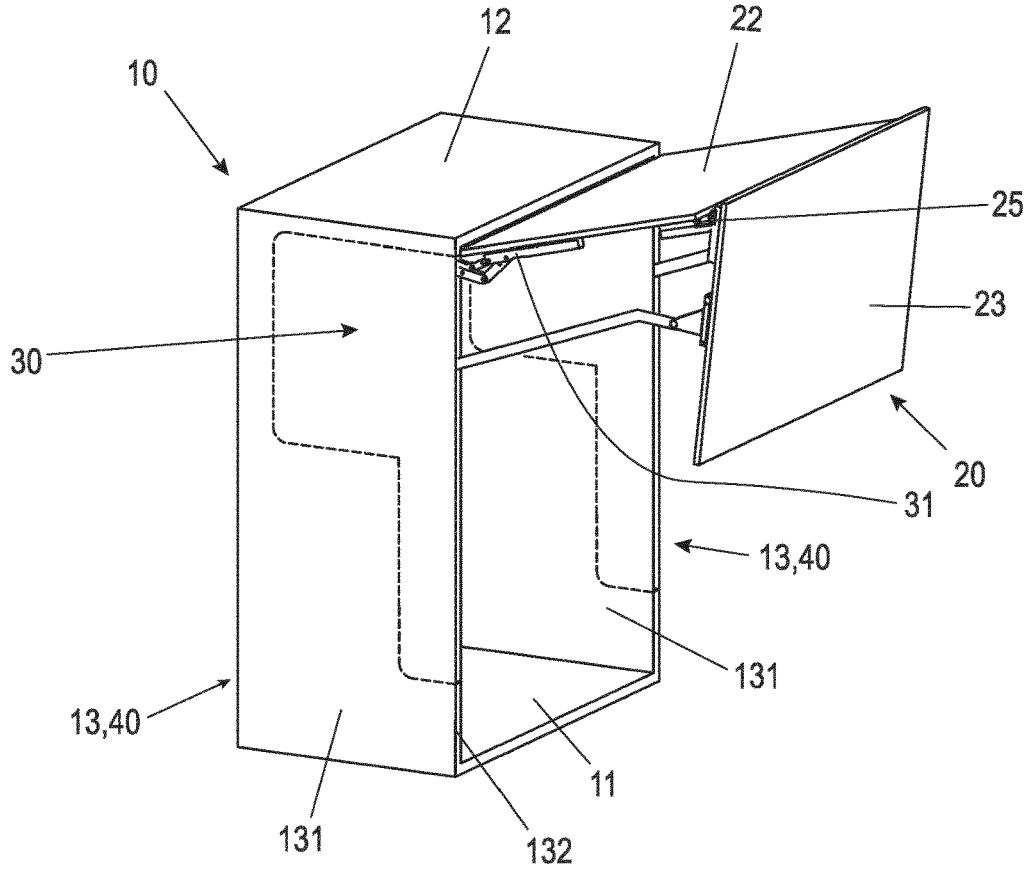

FIGS. 3*a* and 3*b* show another embodiment example of a wall unit with furniture body 10 and flap arrangement 20. FIG. 3*a* shows the flap arrangement 20 in a closed position and FIG. 3*b* in an open position.

This piece of furniture has a two-part flap arrangement 20 with an upper flap part 22 and a lower flap part 23. Again, the side walls 13 are designed as composite elements which accommodate a fitting 30. This is coupled with lever mechanisms 31 both with the upper flap part 22 and with the lower flap part 23. In addition, additional hinges 25 are provided to connect the upper and lower flap parts 22, 23 with each other along their connecting line. Depending on the design of the flap fitting, the hinges can also be omitted.

As in the embodiment example for FIGS. 2*a*, 2*b*, good access to the interior of furniture body 10 is also achieved here without the flap arrangement 20 pivoting too far upwards in the open state for the user to reach.

Figure 4:
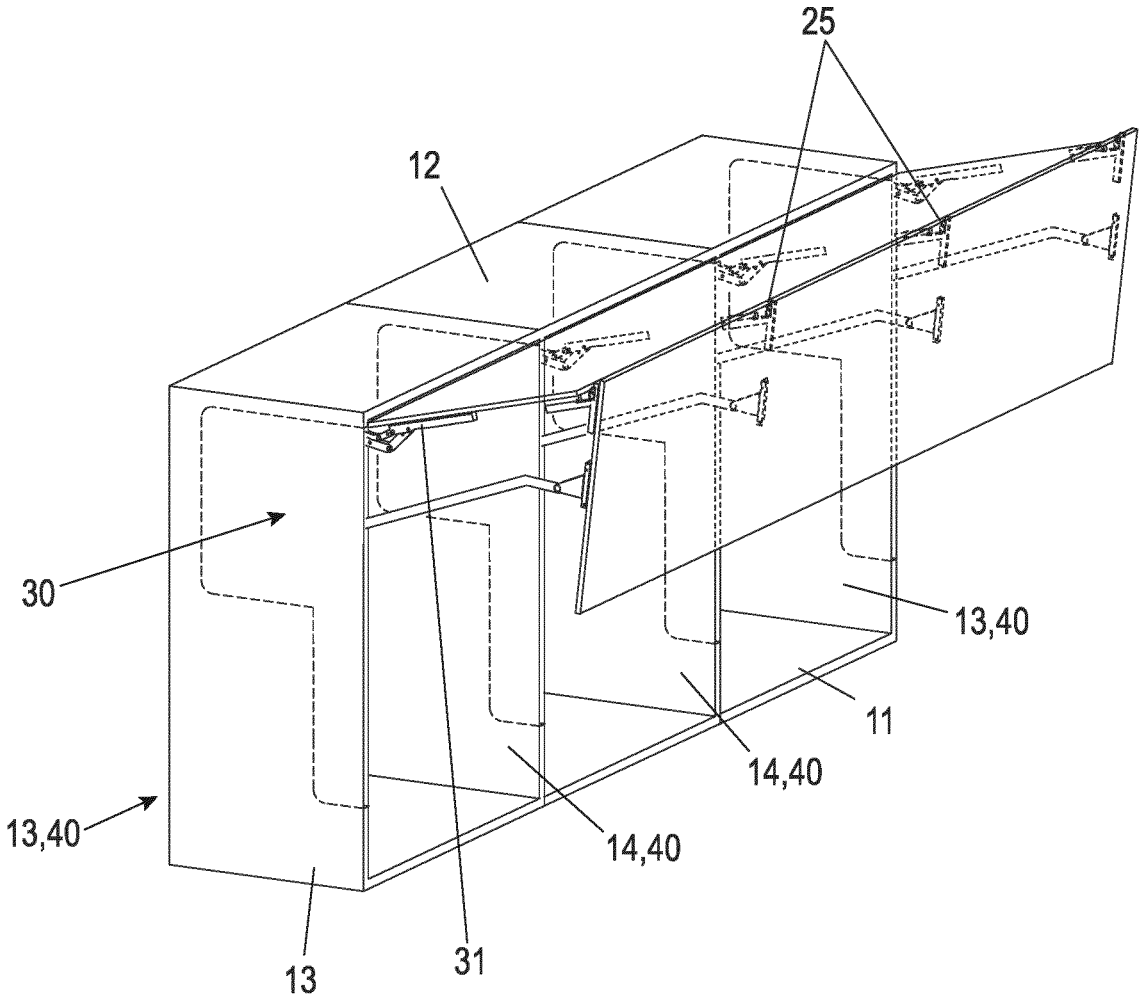
FIG. 4 shows a fourth embodiment example of a piece of furniture having a wall according to the application.

FIG. 4 shows another wall unit with furniture body 10 and flap arrangement 20, in which fittings 30 for guiding the flap arrangement 20 are arranged in composite elements 40. In the example shown, the furniture body 10 has an interior divided by vertical partition walls 14. Two partition walls 14 are provided in this case, which divide the interior into three sections. In this embodiment, each partition wall 14 is designed as a composite element 40. However, the arrangement shown can also be realized with only one partition wall or more than the illustrated two partition walls 14.

The flap arrangement 20 is comparable with the embodiment example of FIGS. 3*a* and 3*b* in two parts with an upper flap part 22 and a lower flap part 23. The flap arrangement 20 extends in its width, and also the upper and lower flap parts 22, 23, over the entire furniture body 10. In order to be able to guide the flap arrangement 20 smoothly, fittings 30 are also present in the intermediate walls 14. Both the side walls 13 and the partition walls 14 are designed as composite elements 40 in accordance with the application.

In all the embodiment examples shown, the composite elements are characterized by continuous side surfaces with a uniform surface look and feel across the entire surface. In particular, no transition in the area of the edge of the fitting 30 is discernible in the surface.

Figure 5:
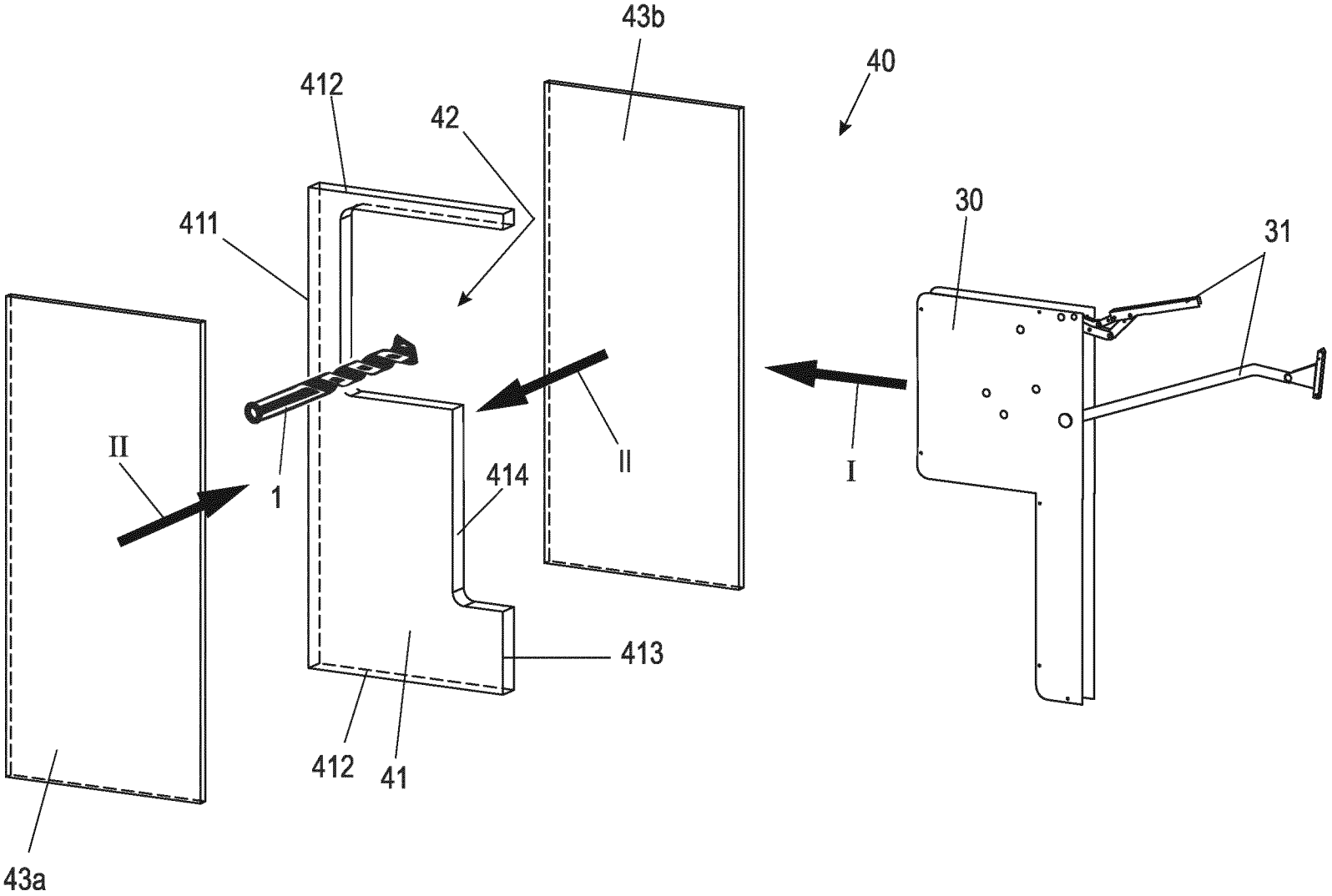
FIG. 5 shows a first embodiment example of a wall according to the application and designed as a composite element in a schematic exploded view.

The basic structure of a first embodiment example of a composite element 40 with which this is achieved is shown in FIG. 5 in an isometric exploded view. The composite element 40 shown can, for example, be used as a side wall 13 in the embodiment examples of FIGS. 1-4 and also as a partition wall 14 in the embodiment example of FIG. 4.

The composite element 40 has a core 41, for example made of chipboard or medium or high density fiberboard (MDF—Medium Density Fiberboard or HDF—High Density Fiberboard). The core 41 has a rectangular offset of the size which later has the sides or partition wall in the furniture body to be manufactured (cf. e.g. side wall 13 of furniture body 10 according to the embodiment examples in FIGS. 1-4). Three end faces, one end face 411, positioned left in FIG. 5, and a lower or upper end face 412 extend straight according to the rectangular offset.

The core 41 has a large, flat recess 42, which is open towards a fourth end face 413. Only in the upper and lower part of the core 41 a narrow section of the end face 413 remained on this side. In the area in between, the edge of the recess 42 now forms an inwardly offset end face 414 that follows the contour of the recess 42.

The contour of the recess 42 corresponds to the outer contour of a fitting 30 to be inserted, here an approximately L-shaped contour. For example, the recess 42 can be milled into the core 41 using the symbolic milling tool 1. Other cutting techniques such as drilling in conjunction with (dip) saw cuts can also be used to create the recess 42. It should be noted that machining can be performed from one of the side surfaces of core 41. Machining only from the end face 413 is not required for core 41, which is initially available separately. Thus, the recess can easily accept any depth (as seen from the original end face 413) and is also suitable for fittings 30 with a large installation depth. The lateral machining direction can also be used to create contours that are not possible by machining only from the end face 413.

After inserting the recess 42 into the core 41, the fitting 30 is inserted into the recess 42 of the core 41 in a first assembly step I and connected to the core 41. Details on possible connections are described in more detail in connection with FIGS. 6 *a-c* and 7 to 11.

The fitting 30 and the core 41 preferably have the same thickness, especially in a range from 15 mm to about 20 mm. The core 41 and the fitting 30 thus form a unit in which the fitting 30 is flush with the surface of the core 41 on both sides. In addition, the front edges of fitting 30 are flush with the two remaining sections of the actual end face 413 of core 41.

In a second assembly step II, which in turn is indicated by corresponding arrows in FIG. 5, cover layers 43*a*, 43*b* are then applied to the unit comprising core 41 and fitting 30 on the corresponding sides of the core 41 or fitting 30, in particular glued or laminated. Preferably, these cover layers 43*a*, 43*b* are already provided with a decorative surface. Their thickness ranges from a few tenths of a millimeter to about 2 or 3 mm. The thickness is dimensioned in such a way that any remaining small edges in the transition area between the core 41 and the fitting 30 are not or should not be recognizable in the surface of the cover layers 43*a*, 43*b*.

In a further manufacturing step not shown here, the remaining end faces 411, 412 and 413 can also be provided with a decorative layer, for example an edge band. If necessary, this step can also be carried out before applying the cover layers 43*a*, 43*b* and also before inserting the fitting 30.

In the manner described, the composite element 40 is created, which in this form can directly form a side wall 13 or a partition wall 14 of a furniture body 10 as shown in FIGS. 1-4 and already has the fitting 30 for guiding a flap arrangement.

FIGS. 6*a-c* and 7-11 show various types of fixing between fitting 30 and the core 41 of the composite element 40.

FIG. 6*a* first shows in an isometric view a core 41 of a composite element 40 before inserting a fitting 30. For the sake of illustration, the core 41 is already shown as the side wall of a furniture body and is already connected to the bottom panel and top panel of the furniture body. This illustrates the later installation position of the composite element 40 in a piece of furniture. In principle, assembly would be conceivable in such a way that a furniture body is partially finished before the fitting 30 is connected to the core 41 and before the cover layers 43*a*, 43*b*, which are not shown here, are placed inside and outside on the core 41. However, a complete prefabrication of the composite element 40 including the application of the cover layers 43*a*, 43*b* is more efficient for production and assembly and therefore preferred.

FIG. 6*b* shows the area of the end face 414 of core 41 at the edge of recess 42 in more detail. At this edge, the core 41 adjacent to the end face 414 is milled off on both sides in such a way that a thinner edge area is formed in the manner of a bung spring 415. The milling process creates shoulder surfaces 416, which form a shoulder opposite the remaining side areas of core 41.

Fitting 30 has two side plates 301 spaced apart from each other, which laterally limit fitting 30 and provide the pivot points for lever mechanism 30. Distance sleeves or bolts are preferably arranged between the side plates 301, which connect the side plates 301 to each other and fix them parallel to each other at a fixed distance. In alternative embodiments of the fitting 30, screw elements can also serve as spacers, which offer the possibility of varying the spacing of the side plates 301 at least slightly and thus adapting it to the thickness of the core 41.

At least in the edge area there are neither bolts nor other elements between the side plates 301 so that the fitting 30 with the side plates 301 can be pushed onto the bung spring 415 of core 41, as shown in FIG. 6*b* with the arrows I. The side plates 301 are preferably spaced from each other on the inside to such an extent that they can be fitted precisely onto the bung spring 415. The thickness of the side plates 301 further preferably corresponds to the depth of the shoulder between the shoulder surfaces 416 and the remaining surface of the core 41. A fitting 30 that has been pushed on thus connects itself as flush as possible to the surface of the core 41.

FIG. 6*c* shows in the left half of the figure the fitting 30 completely pushed onto the bung spring 415. In this position the fitting 30 is then fixed by screws 44, which are screwed into the countersunk holes 302 made close to the edge in the side plates 301. The screws 44 are corresponding to countersunk head screws which are screwed into the core 41 in the area of the bung spring 415 and which are countersunk with their head as flush as possible in the side plates 301. This is shown on the right-hand side of FIG. 6*c* in a sectional drawing showing the core 41 in the area of the bung spring 415 and the edge area of the fitting 30 fitted onto the core 41.

FIG. 7 shows in a similar way to FIG. 6*c* an alternative type of connection between fitting 30 and core 41. As in the example described above, core 41 is milled off in the area of the edge of recess 42, so that a bung spring 415 is formed on which fitting 30 with its parallel side plates 301 is pushed.

In contrast to the example shown in FIG. 6*c*, in this case clamps 45 are used instead of screws 44 to connect fitting 30 to core 41 and to prevent fitting 30 from being pulled forward out of recess 42. The clamps 45 are guided through corresponding holes in the side plates 301 and driven into the material of the core 41. In the example shown in FIG. 7, clamps 45 protrude slightly laterally over the side surface of core 41 or side plates 301. If the cover layers 43*a*, 43*b* of the composite element 40 (not shown here) are applied using an adhesive layer, for example a hot-melt adhesive, this adhesive layer can compensate for the unevenness caused by the clamps 45. Alternatively, it is possible to provide corresponding recesses in the cover layers 301 and the core 41 so that the clamps 45 are flush with the other surface of the side plates 301 and the core 41.

FIG. 8 shows a further alternative to connecting the fitting 30 and the core 41 in the same way as FIGS. 6*c* and 7 respectively. Here, too, the bung spring 415 is formed on the core 41 and the fitting 30 with the two side plates 301 is attached to this bung spring 415, as shown in FIG. 6*b*.

To connect a fitting 30 with a core 41, staples 303 protrude from the material of side plates 301, which claw into a material of a core 41. The exhibited staples 303 are prepared by appropriate cutouts in the side plates 301 and are bent out inwards after the fitting 30 has been attached to the bung spring 415. In the area of the protruding staples 303, small depressions remain in the side plates 301, which, however, are covered by the subsequently applied cover layers 43*a*, 43*b*, which are not shown here. The thickness of the cover layers 43*a* and 43*b* is such that these recesses with their small lateral dimensions are not visible in the finished composite element 40.

FIG. 9 shows another alternative type of connection between the fitting 30 and the core 41. Here, too, a bung spring 415 is formed on the core 41, wherein the resulting shoulder surfaces 416 are narrower than in the previous examples. A web 304 is arranged between the side plates 301 in sections or circumferentially around the edge of the fitting 30, which is attached to the bung spring 415. The web 304 is so far away from the edge that a narrow gap remains between the web 304 and the end face 414 with fitting 30 attached. Before attaching the fitting 30 to the bung spring 415, an adhesive bead 46 is inserted between the web 304 and the end face 414. This can be done on one side, e.g., in the form of a hot-melt adhesive on one of the mentioned elements, e.g., as shown in FIG. 9 on the web 304. Alternatively, it is also conceivable that both elements, the web 304 and the end face 414, are coated with contact adhesive or multi-component adhesive, which binds without activation by increased temperature when the two elements are pressed together. Furthermore, an adhesive can also be used, which is only released when the surfaces to be bonded are pressed together. In the left part of FIG. 9 the contact adhesive bead 46 is schematically drawn as a dashed line.

FIG. 10 shows another type of connection between a fitting 30 and a core 41 of a composite element 40.

In contrast to the examples shown in FIGS. 6*a*-*c* and 7-9, the end face 414 extending along the edge of the recess 42 is not formed exclusively by straight sections adjoining each other at an angle. Instead, undercut connecting elements 417 are present at several places, here for example three, along the end face 414, which in this case have the shape of a cylinder. In the side plates 301 of the fitting 300, corresponding mating contours 305 to the connecting elements 417 are cut out. Instead of the shown cylindrical shape of the connecting element 417 and the corresponding circular section shape of the mating contour 305, other undercut shapes, such as a trapezoidal shape, can also be used.

It is understood that the connecting elements can also be arranged in reverse on fitting 30, and the mating contours accommodating them can also be arranged on core 41.

The core 41 is already connected on one side with a cover layer 43*b*. In a first assembly step I, fitting 30 is placed on the unit consisting of core 41 and cover layer 43*b*, so that the respective connecting elements 417 engage in the cutout mating contours 305 of the side plates 301 as in a puzzle. When assembling, adhesive can be applied to at least selected areas of the side plate 301 or the accessible part of the cover layer 43*b* in cutout 42 to connect the side plate 301 to the cover layer 43*b*. Finally, in a second assembly step II, the opposite cover layer 43*a* is glued or laminated onto the core 41 or the facing side plate 301 of fitting 30.

The embodiment examples of composite elements 40 shown so far in FIGS. 6*a*-6*c* and 7-10 are based on an inseparable, fixed embedding of the fitting 30 in the composite element 40. FIG. 11 shows another embodiment example of a composite element 40 with inserted fitting 30, in which the fitting 30 is pushed from the end face 413 of the composite element into the formed recess 42. Also in this embodiment, the fitting 30 has two mutually parallel side plates 301, on which the levers of the lever mechanism 31 are rotatably mounted and between which the lever mechanism 31 moves in when the flap is closed.

FIG. 11 shows the lever mechanism 31 and a two-part flap here with upper flap part 22 and lower flap part 23 in an extended state. In the gap formed between the two side plates 301, claws 47 are arranged, which can be turned outwards by means of a tool, for example the screwdriver 2 shown in connection with screws 48, and which can be clawed firmly in the area of the end face 414 of the core 41. In the area in which the claws 47 extend over the edge of the side plate 301, depressions 418 in the core 41 can be provided as a support. One of the areas of claws 47 is enlarged in the lower part of FIG. 11. In an alternative embodiment, comparable claws can also be part of core 41, with anchoring points being formed at a suitable position in or on the fitting 30, into which the claws engage.

The advantage of the type of fastening of fitting 30 within the composite element 40 shown in FIG. 11 is that a defective fitting 30 can also be removed and replaced, which is not possible with the fixed fittings 30 in the previously shown embodiment examples of the composite element 40.

In the embodiment examples shown, the recess 42 is approximately L-shaped, wherein a section projecting deeper into the core 41 is arranged in the upper area, in which hinge points for the lever mechanism 31 are also provided. In the lower area, the recess 42 is less deep. In this area, the fitting 30 only needs to be deep enough that, when the flap 20 is closed, the lever mechanism 31 can be immersed in an orientation essentially parallel to the front edge 413.

As an alternative to the additional claws 47 used, the fitting 30 can also be screwed directly to the core 41 at the front end by means of brackets with holes attached to the fitting 30 or fastened with other fastening means.

FIG. 12 shows an embodiment example of a composite element 40 in which the core 41 does not consist homogeneously of one material, but is designed as a composite material. In the edge regions, this core 41 is still made of a compacted material, such as chipboard or an HDF or MDF panel. In an inner area, in particular in the lower part of the core 41, in which the fitting 30 is narrower, a light honeycomb structural material 419, for example a cardboard material, is provided. By using the honeycomb structure material, the weight of the composite element 40 and also the material costs can be reduced. In particular in connection with the applied and preferably glued-on cover layers 43*a*, 43*b*, sufficient stability of the composite element 40 is nevertheless achieved.

The composite element 40 shown in FIG. 12 is also designed for subsequent machining, in particular changing the length and width of the composite element 40. For example, dashed section lines 3 are shown, along which the composite element 40 can be cut to length as required after its manufacture, i.e., after the fitting 30 has been integrated into the core 41 and after the cover layers 43*a*, 43*b*, which are not shown here, have been applied. For example, a prefabricated composite element 40 with integrated fitting 30 can also be used in joineries or smaller manufactories to produce tailor-made furniture.

Further fittings such as cabinet hangers or connecting elements for e.g., interior organization or connecting interfaces for furniture body 10 can be integrated into the composite element 40. Electrical cables and other electrical components can also be integrated into the composite element 40 for electrification of the composite element 40. The integration of lighting equipment such as LED luminaires is also possible.

The embodiment examples relate to pieces of furniture in which the doors or flaps are guided by fittings which are largely integrated into vertically arranged side walls or partition walls of the furniture.

The fittings 30 shown as part of this application are each equipped with a lever mechanism 31. Other types of fittings with other types of guidance of coupled movable furniture parts can also be used.

FIG. 13 shows a top view of the front end face 413 of a section of a composite element 40 in the area of fitting 30. In this embodiment example, an edge band 49 is applied as a narrow-side coating to the front end face 413 of core 41 and thus of the composite element 40. Further edge bands not visible here can be applied in the area of the upper or lower end faces 412 or the rear end face 411.

In the area of the opening of the fitting 30, from which, for example, the lever mechanism 31 (not visible in this illustration) extends, the edge band 49 is recessed. The edge band 49 is applied to the front end face 413 after integration of fitting 30 into the composite element 40 or also after insertion of fitting 30 into the composite element 40 (see FIG. 11).

The edge band 49 is cut out so that it rests in sections on fitting 30 and covers, for example, the edges of the side plates 301 of fitting 30 or other elements visible outside the opening of fitting 30. In FIG. 13 the contours of fitting 30 are dashed.

Due to the arrangement of the edge band 49 also on sections of the fitting 30, the fitting 30—with the exception of the extendable lever mechanism 31—is completely integrated into the composite element 40 and no longer visible at the front end face 413 of the composite element 40.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE NUMERALS

1 Milling tool
2 Screwdriver
3 Intersection line
10 Furniture body
11 Bottom panel
12 Top panel
13 Side wall
131 Side surface
132 End face
133 Opening in end face
14 Partition wall
20 Flap arrangement
21 Integral flap
22 Upper flap part
23 Lower flap part
24 Handle
25 Hinge
30 Fitting
301 Side plate
302 Lug
303 Projecting staple
304 Web
305 Mating contour
31 Lever mechanism
40 Composite element
41 Core
411 Rear end face
412 Upper or lower end face
413 Front remaining end face
414 End face of the recess
415 Bung spring
416 Shoulder surface
417 Connecting elements
418 Depression
419 Honeycomb structural material
42 Recess
43*a, b* Cover layer
44 Screw
45 Clamp
46 Adhesive bead
47 Claw
48 Screw
49 Edge band
I, II Assembly step

The invention claimed is:

1. A wall for a furniture body, the wall comprising:
a panel-shaped core arranged between two laterally positioned cover layers, wherein
the panel-shaped core has a recess extending at least along a section of an end face of the wall and receives a fitting that guides a movable furniture part,
the fitting rests against at least one of the two laterally positioned cover layers and is connected to the panel-shaped core and/or at least one of the two laterally positioned cover layers,
the panel-shaped core has a reduced thickness along an edge of the recess on at least one side in such a way that a bung spring facing towards the recess is formed, which bung spring projects into the fitting that guides the moveable furniture part, and
the fitting comprises a lever mechanism, which includes a coupling for fixing the fitting to the moveable furniture part and which guides the movable furniture part.

2. The wall of claim 1, wherein the fitting rests against both of the two laterally positioned cover layers.

3. The wall of claim 1, wherein the fitting has two parallel side plates between which a gap is formed at least in sections along one edge, into which the bung spring projects.

4. The wall of claim 3, wherein screws or clamps connect the two parallel side plates to the panel-shaped core.

5. The wall of claim 4, wherein heads of the screws or overlapping sections of the clamps are arranged between the two parallel side plates and two laterally positioned cover layers.

6. The wall of claim 5, wherein the heads of the screws or the overlapping sections of the clamps are recessed in the two parallel side plates.

7. The wall of claim 3, wherein staples projecting from the two parallel side plates connect the two parallel side plates to the panel-shaped core.

8. The wall of claim 1, wherein the fitting is bonded to the panel-shaped core and/or at least one of the two laterally positioned cover layers.

9. The wall of claim 1, wherein connecting elements are formed from the panel-shaped core adjacent to the recess and engage into the fitting, and wherein the fitting has side plates with recesses, the recesses of the side plates forming mating contours into which the connecting elements engage.

10. The wall of claim 9, wherein the fitting is bonded to the panel-shaped core and/or at least one of the two laterally positioned cover layers.

11. The wall of claim 1, wherein the fitting has two parallel side plates having a spacing corresponding to a thickness of the core.

12. The wall of claim 1, wherein the lever mechanism is located between the two laterally positioned cover layers in a closed state of the movable part of the furniture.

13. The wall of claim 12, wherein the side plates have an adjustment unit with which thickness compensation to the core is performed.

14. The wall of claim 1, wherein one of the end faces of the panel-shaped core is covered by at least one edge band.

15. The wall of claim 14, wherein the at least one edge band is arranged at least in sections on the fitting.

16. A method for manufacturing a wall for a furniture body, the method comprising:

providing a panel-shaped core;

introducing a recess into the panel-shaped core, the recess extending along at least a section of an end face of the panel-shaped core;

forming, in the panel-shaped core, a reduced thickness along an edge of the recess on at least one side in such a way that a bung spring facing towards the recess is formed;

applying two lateral cover layers to the panel-shaped core;

wherein the recess is milled out of the panel-shaped core with a milling tool from a side surface of the panel-shaped core;

wherein a fitting is inserted into the recess before at least one of the two lateral cover layers is applied to the panel-shaped core in such a way that the bung spring projects into the fitting;

wherein the fitting is screwed, clamped, and/or glued to the panel-shaped core before the at least one of the two lateral cover layers is applied to the panel-shaped core; and wherein the fitting comprises a lever mechanism, which includes a coupling for fixing the fitting to the moveable furniture part and which guides the movable furniture part.

17. The method of claim 16, wherein the fitting is inserted and connected to the panel-shaped core before the two lateral cover layers are applied.

18. A piece of furniture or a furniture body, comprising:

at least one wall, which comprises a panel-shaped core arranged between two laterally positioned cover layers, wherein the panel-shaped core has a recess extending at least along a section of an end face of the wall and receives a fitting that guides a movable furniture part, the fitting rests against at least one of the two laterally positioned cover layers and is connected to the panel-shaped core and/or at least one of the two laterally positioned cover layers, the panel-shaped core has a reduced thickness along an edge of the recess on at least one side in such a way that a bung spring facing towards the recess is formed, which bung spring projects into the fitting that guides the moveable furniture part, and the fitting comprises a lever mechanism, coupled to the moveable furniture part, that guides the movable furniture part.

19. The piece of furniture or furniture body of claim 18, wherein the at least one wall is a side wall or a partition wall.

20. The piece of furniture or furniture body of claim 18, wherein the fitting is a flap fitting or a door fitting.

* * * * *